United States Patent [19]

McLeod

[11] 4,301,561

[45] Nov. 24, 1981

[54] SEPARABLE, FITTED LINER AND BED SHEET FOR WATERBEDS

[76] Inventor: Margaret McLeod, 10320 Tenby La., Apt. 201, Thornton, Colo. 80229

[21] Appl. No.: 5,683

[22] Filed: Jan. 23, 1979

[51] Int. Cl.[3] ..... A47G 9/02

[52] U.S. Cl. ..... 5/496; 5/498; 5/499

[58] Field of Search ..... 5/495, 496, 498, 499, 5/500, 501, 502, 451, 452, 482, 470, 471, 497

[56] References Cited

U.S. PATENT DOCUMENTS

| | | | |
|---|---|---|---|
| 2,630,587 | 3/1953 | Brown | 5/496 |
| 3,530,487 | 9/1970 | Beer | 5/500 |
| 3,832,743 | 9/1974 | Smith | 5/496 |
| 4,035,854 | 7/1977 | Pardee | 5/497 |
| 4,045,832 | 9/1977 | DiForti | 5/496 |
| 4,057,862 | 11/1977 | LaBianco | 5/451 |

FOREIGN PATENT DOCUMENTS

| | | | |
|---|---|---|---|
| 1445600 | 6/1966 | France | 5/496 |

*Primary Examiner*—Ramon S. Britts
*Assistant Examiner*—Alexander Grosz
*Attorney, Agent, or Firm*—John E. Reilly

[57] ABSTRACT

An improved sheet and liner for waterbeds and the like is provided for use in cooperation with a mattress pad wherein the liner has inner and outer connective strips along its peripheral edge. The mattress pad is provided with a connective strip for attachment to the inner strip on the liner while the sheet is provided with a connective strip for attachment to the outer strip on the liner. A second sheet may be connected to the first sheet along a selected edge thereof.

3 Claims, 7 Drawing Figures

SEPARABLE, FITTED LINER AND BED SHEET FOR WATERBEDS

BACKGROUND OF THE INVENTION

In recent years, waterbeds have become increasingly in vogue. The waterbeds are produced in a variety of sizes and manufacturers have included a multiplicity of optional features. Regardless of these features, however, the standard waterbed comprises a large, generally rectangular pillow or bladder which is adapted to be filled with a substantial quantity of water. A frame is provided to support this bladder along its lower surface as well as along its sidewalls. Further, to minimize the danger of damage should the bladder break or leak, a liner is mounted between the support frame and the bladder itself to retain the water should the bladder rupture.

Although waterbeds are found to be comfortable a significant problem has arisen when purchasers thereof desire to adapt conventional bedding to the construction of the waterbed. These problems arise since the bladder or mattress is quite heavy so that the linens cannot be readily placed thereunder and there is a tendency for the bed linens, such as, mattress pads and sheets, to slip across the mattress and to be in a state of disarray. This situation is particularly inconvenient to the sleeper and can cause a considerable amount of discomfort.

Various attempts have been made to overcome the problems caused by the slippage of bedding on the mattress or the like, and there have been examples of attempted solutions of this problem directed specifically to waterbeds. For example, U.S. Pat. No. 4,057,862 issued to LaBianco discloses a skirt attachable to a pivotal portion of a waterbed frame between that portion and the water bladder. A cover sheet may then be attached to this skirt so that it is maintained in place.

Although not directed specifically to waterbeds, another example of an attempt to attach bedding to a mattress so as to prevent slippage is disclosed in U.S. Pat. No. 2,630,587 to Brown. This patent discloses a combination sheet and mattress wherein the mattress is provided with a plurality of snaps at its corners and midway along two sidewalls, and the cover sheet is provided with associated snap-on panel portions so that these panel portions hold alongside the sidewall of the mattress adjacent thereto and interconnect with the snaps on the mattress. Similarly, U.S. Pat. No. 4,045,832 to DiForti et al discloses a fitted sheet for a mattress which is stitched together in a mitered corner to conform to the shape of a mattress. A pair of tabs adjacent to this corner fold under the mattress and include a Velcro pad so that they attach to one another thereby locking the sheet onto the mattress.

U.S. Pat. No. 3,832,743 to Smith discloses an upper sheet which is attachable to a lower fitted sheet by means of a Velcro strip, one portion of which is mounted midway on the sidewall of the fitted sheet with the other portion being mounted on the edge of the upper sheet. A flap attached to the fitted sheet overlies the attachment strip and by so constructing the sheet the upper sheet may not readily be separated along that edge from the fitted sheet.

U.S. Pat. No. 3,530,487 to Beer discloses a bedding assembly having elements releasably attached by means of zippers to a mattress. In this patent, a mattress pad is attached to the upper portion of the sidewall of the mattress and a lower sheet is attached to the midportion of the sidewall. A skirt is attached by a zipper around the bottom of the mattress and this skirt extends upwardly the length of the sidewall and terminates in a pair of zippers to which an upper sheet and a blanket may be attached. In this manner, each component part of the bedding assembly is secured along its edges to the mattress thereby maintaining it in position.

Therefore, there exists a need for an improved system of bedding for a waterbed and the like so constructed and arranged that the bedding liners and sheets will remain securely in place despite use of the waterbed; yet the sheets are readily detachable from the liner encasing the waterbed when desired.

SUMMARY OF THE INVENTION

It is therefore an object of the present invention to provide a novel and improved system of bedding which will remain securely in place despite use of a waterbed.

It is a further object of the present invention to provide a bedding system in which the parts thereof are releasably secured to one another in such a way as to avoid the necessity of tucking the sheet or sheets under the mattress.

It is yet another object of the present invention to provide an economical bedding assembly including a liner and sheet, which assembly is convenient to maintain and which will allow releasable attachment of its parts to facilitate cleaning or replacement of the bedding.

It is still a further object of the present invention to provide for waterbeds and the like an integrated system of bedding wherein an underliner, a mattress pad and a plurality of sheets which are interconnectable along their peripheral edges so as to enclose the bladder of a waterbed and secure the sheets in place so as to be resistant to slippage or any tendency to be disarranged once it is placed on the waterbed.

To accomplish these objects, a bedding liner and sheet assembly for waterbeds and the like is provided wherein an underliner is inserted between the bladder and the liner of the waterbed prior to filling the bladder with water. The underliner has connecting strips, such as hook and thistle strips sold under the trademark of Velcro, along its peripheral edges. A mattress pad is adapted to be placed on top of the bladder and has connective strips which connect the peripheral edges of the underliner on the inside thereof. A sheet is then placed over the mattress pad and is provided with peripheral connective strips which overlap the edges of the mattress pad to connective strips on the outer side of the underliner. In this manner, one of the sheets, underliner and mattress pads is sandwiched between the other two of this assembly with this sandwiching taking place at the peripheral edges of the constituent parts of the assembly.

In addition, it is preferred that a pair of sheets are sewn together along one peripheral edge to be placed at the foot of the bed, the upper sheet being of a width greater than the lower sheet so that it can be tucked in along the sides of the bed or bed frame. By attaching the lower sheet to the underliner, both the lower sheet and the upper sheet thereby become releasably secured in place so as to prevent disarrangement when a sleeper rests between the upper and lower sheets on the waterbed.

Another unique feature of the assembly is the formation of gaps or spaces at the corners of the liner and sheets thereby eliminating the neccessary folds and facilitating their interconnection to one another in close fitting relation to the waterbed. Where an upper sheet is provided, however, it is preferred that there be full corners without such gaps since this sheet may conveniently be tucked along the edge of the waterbed. In the alternative, snap panels are provided at the corners of the parts of the bedding assembly to serve as supplementary means of releasable attachment between the liner and the sheets.

The above and other objects of this invention will become more fully appreciated in view of the following detailed description taken in conjunction with the accompanying drawings, in which:

DETAILED DESCRIPTION OF THE PREFERRED EMBODIMENT

The preferred embodiment of the present invention is illustrated in FIGS. 1 to 6 wherein a bedding liner and sheet assembly 10 is specifically adapted for use in association with a waterbed. Conventionally, the waterbed is comprised of a bladder B which is supported in an open, rectangular frame, not shown, having a flat base or undersupport to elevate the bladder above the floor surface.

Figure 1:
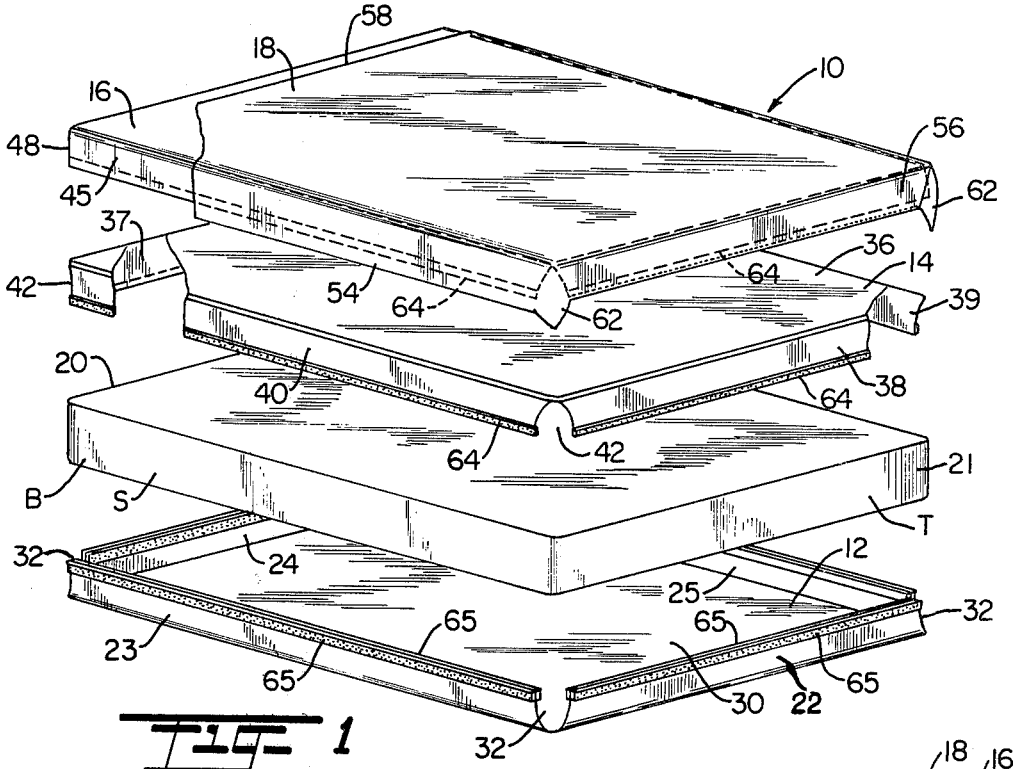
FIG. 1 is an exploded perspective view which is partially broken away showing the preferred embodiment of the bedding assembly and waterbed according to the present invention.

The bedding liner and sheet assembly 10 in the preferred embodiment of the present invention, as shown in FIG. 1, is broadly comprised of an underliner 12, a mattress pad 14, a first lower or bottom sheet 16 and a second upper or top sheet 18. Bedding assembly 10 is shown encasing mattress or bladder B, although it is to be understood that the bladder B comprises no part of the present invention. That is, the present invention is adapted to fit various types of mattresses, such as a standard mattress or coil spring mattress, as well as a bladder for a waterbed and the like. Also, within some degree of tolerance, the present assembly will fit different sizes or configurations of mattresses or bladders and is conformable for adjustable attachment to water-filled bladders whether the same are overfilled or underfilled.

Figure 2:
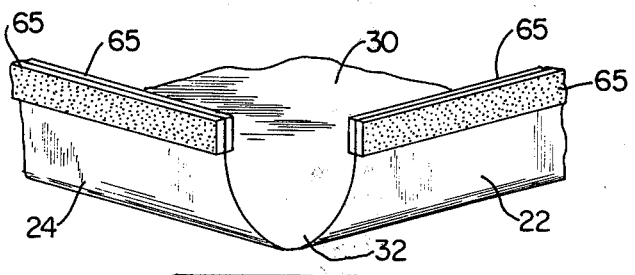
FIG. 2 is a perspective view of the corner of one element, namely, the underliner, of the preferred embodiment shown in FIG. 1.
Figure 3:
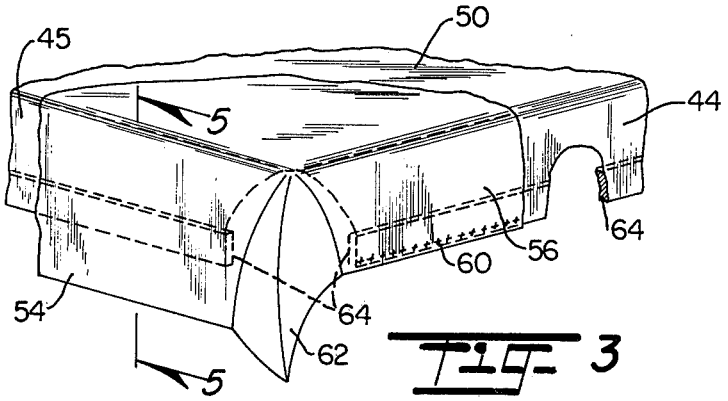
FIG. 3 is a perspective view of the upper two elements of the preferred embodiment of the present invention showing one superimposed upon the other.

As may be seen with reference to FIGS. 1, 2 and 3, the elements of the bedding assembly 10 are all constructed to lay flat and may be readily folded when not in use. Specifically, underliner 12 has side panel edge portions 23 and 25 and end panel edge portions 22 and 24 attached to bottom panel 30. Underliner 12 has cutout portions or gaps 32 at all four corners, and these gaps 32 are generally U-shaped so that panel edge portions 22 to 25 will terminate adjacent to but just short of the corners of bladder B. In this way, the panel edge portions 22 to 25 will extend vertically along the side walls S and end walls T of bladder B when underliner 12 is placed beneath bladder B without having to be folded over the corners thereof. As may be seen in FIG. 1, panel edge portion 22 is adapted to be placed along the foot end 21 of bladder B alongside one of end walls T while panel edge portion 24 is adapted to be placed along head end 20 of bladder B. It should be understood, however, that the head and foot ends of the bed are to be selected by the user with the above designation being only for purposes of description herein.

In a manner similar to underliner 12, mattress pad 14 has a top panel 36 and a plurality of side or panel edge portions 37, 38, 39 and 40 which form side panel edge portions 39 and 40 and end panel edge portions 37 and 38. Again, a plurality of generally U-shaped cutout portions or gaps 42 are provided at each corner of mattress pad 14 so that the associated panel edge portions 37 to 40 terminate short of the corners of the bladder B. Panel edge portion 38 is adapted to fit along foot end 21 of bladder B while panel edge portion 37 is adapted to fit along head end 20 of bladder B.

Figure 4:
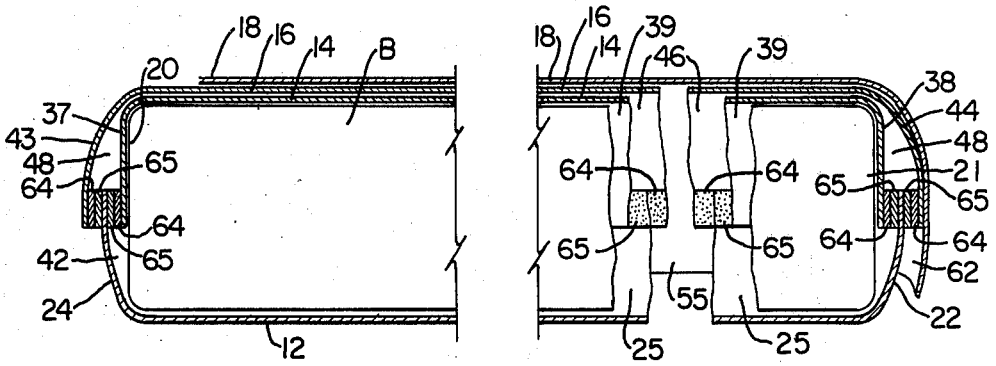
FIG. 4 is a partially broken away cross-sectional view taken lengthwise of the bedding assembly according to the preferred embodiment of the present invention shown in assembled relation to a mattress.

Finally, as best seen in FIGS. 1 and 4, bottom sheet 16 has a plurality of side panel edge portions 45 and 46 and end panel edge portions 43 and 44 which are adapted to extend downwardly along the sidewalls S and end walls T of bladder B, respectively. Once more, generally U-shaped cutout portions or gaps 48 are provided at the corners of bottom sheet 16 to facilitate the downward extension of panel edge portions 43–46 and to avoid unnecessary folding or bunching of the material at the corners of bladder B. Panel edge portion 43 fits along the head and end of the bladder while panel edge portion 44 extends along the foot end of the bladder. Panel edge portions 43 to 46 of bottom sheet 16 are attached at one end to body panel 50 which forms the main body of bottom sheet 16 as shown in FIG. 3.

To complete the bedding assembly 10, a top sheet 18 is preferably provided and has opposite side panel edge portions 54 and 55 and a foot end portion 56; however, the upper or head end of top sheet 18, which is positioned at head end 20 of bladder B, is not necessarily of a length to extend beyond the head end of bladder B. The construction of top sheet 18 may best be shown with reference to FIGS. 1, 3 and 4, and as shown in FIG. 1, most desirably the head end of top sheet 18 will terminate as at 58 along the head end of body panel 50 of bottom sheet 16. As shown in FIGS. 3 and 4, side panel edge portions 54 and 55 are dimensioned to extend or drape downwardly along sides S of bladder B to a point beyond the lower terminal edges of the side panel edge portions 39 and 40 of mattress pad 14 as well as the lower terminal edges of side panel edge portions 35 and 36 of bottom sheet 16. Also, it is preferred that the foot end panel edge portion 56 of top sheet 18 is sewn or stitched to the terminal edge or hem of panel edge portion 44 at the foot end of bladder B as illustrated at 60 in FIGS. 3 and 4. Thus, the top sheet will be secured to the bottom sheet only along the foot end and will not be provided with gaps or cutout portions at its corners so that side panel edge portions 54 and 55 will have loose folds 62 at their juncture with the foot panel end portion 56.

An important feature of the present invention resides in the adjustable and releasable interconnection of the various elements of the bedding assembly. In order to enable interconnection of the parts or elements in the preferred embodiment, a plurality of connective mating strips such as adhering strips 64 and 65 are provided to obtain a secure yet releasable attachment of one element or part to another. Adhering strips 64 and 65 are, in the preferred embodiment, constructed of a hook and thistle material such as that sold under the trademark Velcro. It should be appreciated that the hook and thistle strips are formed as a pair with one strip 64 comprising a multitude of threadlike loops with the associated strip 65 comprising a multitude of small plastic finger-like hooks. When these strips are placed together, the loops and hooks adhere to one another to form a resistant yet releasable bond.

In the preferred embodiment, underliner 12, mattress pad 14 and bottom sheet 16 are all provided with adhering strips 64 and 65 arranged along the peripheral or free edges of their respective panel edge portions. Specifically, underliner 12 is provided with a plurality of strips 65 on the outer edge of panel edge portions 22 to 25. As may be seen in FIG. 1 and in greater detail in FIGS. 2 and 4, underliner 12 has adhering strips 65 secured to the inner surfaces of panel edges 22 to 25.

Further, underliner 12 has adhering strips 65 secured to the outer surfaces of the panel edges 22 to 25. These adhering strips 65 are mounted to extend substantially the full length of these panel portions.

Mattress pad 14 has mating adhering strips 64 secured on its outer surface along the outer panel edge portions 37 to 40. It should be appreciated that adhering strips 64 on mattress pad 14 must be complementary to adhering strips 65 on underliner 12 so that they will adhere to one another as explained. Of course, since it is only necessary that a complementary mating pair of strips 64 and 65 be provided, the strips on underliner 12 and mattress pad 14 could be interchanged so long as they remain complementary.

Bottom sheet 16 is also provided with adhering strips 64 on the inner surfaces of panel edge portions 33 to 46 so as to be disposed in confronting relation to adhering strips 65 on the outer surfaces of panel edges 22 to 25 on the underliner 12. Once again, strips 64 on panel edge portions 43 to 46 are mounted along the outer or free edge of the panel portions and extend substantially for the full length thereof. The strips could once again be interchanged between bottom sheet 16 and mattress pad 14 so long as they remain a complementary mating pair.

Figure 5:
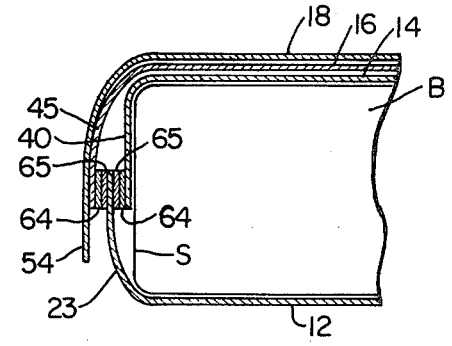
FIG. 5 is a cross-sectional view taken about lines 5—5 of FIG. 3.

The attachment of the various elements of bedding assembly 10 may be more readily understood by reference to FIGS. 4 and 5 which show cross sections of bedding assembly 10 with underliner 12, mattress pad 14, bottom sheet 16 and top sheet 18 attached to one another. As shown in FIG. 4, underliner 12 is adapted to be placed beneath bladder B and must be placed thereunder prior to its being filled with water. This condition is not as critical however when the bedding assembly is used with a conventional mattress. Panel edge portions 22 to 25 of underliner 12 extend upwardly along the sidewalls S and end walls T of bladder B to a point approximately midway thereof. Mattress pad 14 is then positioned over bladder B with panel edge portions 37 to 40 extending downwardly along sidewalls S and end walls T to a point midway thereof so as to slightly overlap panel edge portions 22 to 25 of underliner 12. In this manner, the inner adhering strips 65 on underliner 12 which are oriented toward bladder B are directly adjacent to the outer adhering strips 64 on panel edge portions 37 to 40 so that they will adhere to one another.

Bottom sheet 16 is fitted over mattress pad 14 with panel edge portions 43 to 46 extending downwardly adjacent to sidewalls S of bladder B. Panel edge portions 43 to 46 overlap panel edge portions 22 to 25 slightly, and adhering strips 64 on panel edge portions 43 to 46 are adapted to mate with the adhering strips 65 on the outer surfaces of the panel edge portions 22 to 25 of underliner 12. In this manner, then, underliner 12 is sandwiched between mattress pad 14 and bottom sheet 16.

In use, underliner 12 is first placed beneath bladder B and, after bladder B is filled with water, mattress pad 14 is placed on top of bladder B. Adhering strips 64 and 65 are then adhered to one another so that bladder 20 is substantially encased by underliner 12 and mattress pad 14. After attaching mattress pad 14 to underliner 12, bottom sheet 16 is then placed over mattress pad 14 and its associated panel edge portions are attached to the panel edge portions of underliner 12 by means of its adhering strips 64 and 65. Since top sheet 18 is attached by means of stitching 60 to the bottom edge of bottom sheet 16, it may then be turned back over bottom sheet 16 so that it completes the making of the bed assembly 10. In this manner, the skirts or side panel edge portions 54 and 55 of top sheet 18 then hang down beyond adhering strips 64 and 65 with fold 62 covering the two corners of mattress 20 at its foot end thereby providing a pleasing appearance. It should be further appreciated that it is not necessary that underliner 12 completely cover the bottom of mattress 20 but rather must only extend beneath mattress 20 for a sufficient distance to prevent substantial movement of underliner 12 relative to mattress 20 thereby providing a taut attachment structure for mattress pad 14 and bottom sheet 16.

Also, it should be appreciated that other configurations of adhering strips 64 and 65 are possible wherein bottom sheet 16 could be sandwiched between mattress pad 14 and underliner 12 with bottom sheet 16 having inner and outer adhering strips. Similarly, mattress pad 14 could be sandwiched between underliner 12 and bottom sheet 16 and provided with inner and outer adhering strips. It is only important that two of these three elements be attachable to the third or common element of bedding assembly 10. In the preferred embodiment, as described above, underliner 12 provides a common attachment element for both mattress pad 14 and bottom sheet 16.

Figure 7:
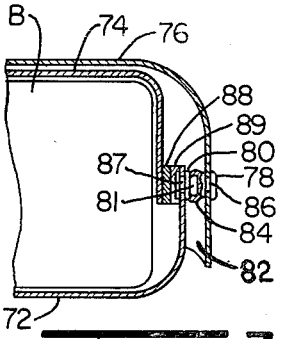
FIG. 7 is a cross-sectional view of one end of the alternate embodiment of the present invention showing the attachment of the upper and lower elements thereof.
Figure 6:
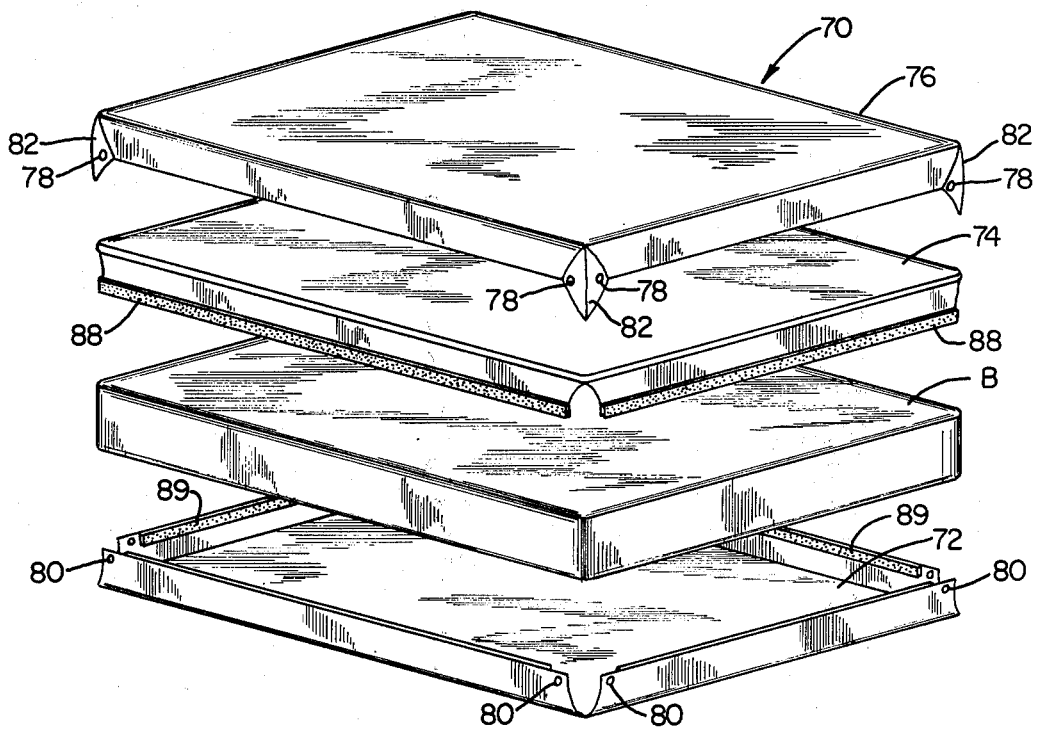
FIG. 6 is an exploded perspective view of an alternative embodiment of the present invention.

An alternate embodiment of the present invention is shown in FIGS. 6 and 7, and departs only from the described preferred embodiment in its attachment at the corners of bladder B. Hence, the broad features of the alternate embodiment will be described with specific reference only to the areas of departure from the preferred embodiment since the remaining assembly is the same.

As shown in FIG. 6, a bladder B is provided with a bedding assembly 70 which broadly includes an underliner 72, a mattress pad 74 and a sheet 76. As in the preferred embodiment, both the underliner 72 and the mattress pad 74 have a plurality of panel edge portions which are attached to one another by means of hook and thistle strips 88 and 89 which are mounted to the panel edge portions at the outer peripheral edge or free edge and mate to one another. As shown in FIG. 7, mattress pad 74 is positioned for attachment to underliner 72 so that it is sandwiched between bladder B and underliner 72.

The point of departure of the alternate embodiment from the preferred embodiment resides in the use of snap fasteners to attach sheet 76 to underliner 72 rather than the hook and thistle strip provided in the preferred embodiment. Specifically, sheet 76 is provided with a plurality of female snaps 78 at each corner. In the alternate embodiment, each corner is provided with a pair of snaps 78, and a fold 82 is provided at each corner so that sheet 76 may be laid flat and conveniently folded. Folds 82 are adapted to extend along the corners of bladder B.

Finally, underliner 72 is provided with a plurality of male snaps 80 at the corners thereof which are adapted to releasably interlock with female snaps 78 of sheet 76. As seen in FIG. 7, female snap 78 has a cup-shaped receiving portion 84 which is attached to sheet 76 by means of rivet 86. Male snap 80 has a male member 81 secured to underliner 72 by means of rivet 87.

After assembling the bedding assembly 70 as shown in FIGS. 6 and 7, the user may place a conventional top sheet over sheet 76 and the desired blankets or bedspreads may be placed on top of this assembly. Indeed, a second sheet may be sewn to the foot end of sheet 76 in the manner described with respect to the preferred embodiment.

Although the present invention has been described with a certain degree of particularity, it is understood that the present disclosure has been made by way of example and that changes in details and structure may be made without departing from the spirit and scope as defined by the appended claims.

I claim:

1. A bedding liner and sheet assembly for a waterbed mattress and the like having opposite sidewalls, a foot end and a head end, comprising:

a rectangular underliner adapted for positioning beneath said mattress and having a first surface adjacent said mattress and a second surface opposite said first surface, said underliner having side and end wall portions extending upwardly along said sidewalls and ends of said mattress including U-shaped cut-out portions at its corners, first fastening means on said first surface extending lengthwise continuously around the peripheral edges of said side and end panel portions and second fastening means on said second surface extending lengthwise continuously around the peripheral edge of said side and end panel portions, said first and second fastening means defined by elongated, releasably connectable mating hook and thistle fastener strips;

a mattress pad adapted for positioning over said mattress and having side and end panel portions extending vertically along the sidewalls and ends of said mattress including U-shaped cut-out portions at its corners, first complementary fastening means in the form of elongated, releasably connectable hook and thistle fastener strips extending lengthwise continuously along said side and end panel portions of said mattress pad for releasably interconnecting said mattress pad to said first fastening means of said underliner;

a first sheet adapted for positioning over said mattress pad and having side and end panel portions extending vertically along the sidewalls and ends of said mattress including second complementary fastening means in the form of elongated, releasably connectable hook and thistle fastener strips extending lengthwise continuously along said side and end panel portions for said first sheet and adapted for releasably interconnecting said first sheet to said second fastening means of said underliner; and a second sheet adapted for positioning over said first sheet, said second sheet having an end panel portion permanently connected at one edge to an end panel portion of said first sheet along said foot end of said mattress and provided with loose folds at the corners of said connected end panel portion overlying said U-shaped cut-out portions of said underliner and mattress pad.

2. A bedding liner and sheet assembly according to claim 1, wherein said elongated, connective hook and thistle fastener strips extend in coextensive relation to one another along the edge of each of said end panel edge portions.

3. A bedding liner and sheet assembly according to claim 2 wherein said rectangular underliner has a plurality of pairs of said connective strips on the edges of its side and end panel edge portions, one of each said pair of strips being mounted on said first surface and the other of said pair of strips being mounted on said second surface, said mattress pad having a plurality of said connective strips mounted on the edges of its side and panel edge portions and adapted for attachment to associated said connective strips on said first surface of said underliner, and said first sheet having a plurality of said connective strips mounted on the edges of its panel edge portions and adapted for attachment to associated said connective strips on said second surface of said underliner.

* * * * *